US007107711B2

(12) United States Patent
Schrode

(10) Patent No.: US 7,107,711 B2
(45) Date of Patent: Sep. 19, 2006

(54) TOOL MOUNTING DEVICE

(75) Inventor: Rainer Schrode, Hayingen (DE)

(73) Assignee: MTS Gesellschaft fuer Maschinentechnik und Sonderbauten mbH, Hayingen (DE)

( * ) Notice: Subject to any disclaimer, the term of this patent is extended or adjusted under 35 U.S.C. 154(b) by 62 days.

(21) Appl. No.: 10/505,050

(22) PCT Filed: Feb. 12, 2003

(86) PCT No.: PCT/EP03/01354

§ 371 (c)(1),
(2), (4) Date: Aug. 18, 2004

(87) PCT Pub. No.: WO03/071036

PCT Pub. Date: Aug. 28, 2003

(65) Prior Publication Data

US 2005/0198873 A1 Sep. 15, 2005

(30) Foreign Application Priority Data

Feb. 20, 2002 (DE) ..... 102 07 066

(51) Int. Cl.
*E02F 3/96* (2006.01)

(52) U.S. Cl. ..... 37/403; 37/904

(58) Field of Classification Search ..... 37/403, 37/468, 904; 414/912, 468
See application file for complete search history.

(56) References Cited

U.S. PATENT DOCUMENTS

| | | | | |
|---|---|---|---|---|
| 4,698,926 | A * | 10/1987 | Caplis et al. | 37/403 |
| 4,906,161 | A * | 3/1990 | Weyer | 414/705 |
| 5,244,306 | A | 9/1993 | Artzberger | |
| 5,398,430 | A * | 3/1995 | Scott et al. | 37/142.5 |
| 5,404,660 | A | 4/1995 | Webster | |
| 5,596,824 | A * | 1/1997 | Scott et al. | 37/403 |
| 6,158,362 | A * | 12/2000 | Culley | 111/117 |
| 6,179,520 | B1 * | 1/2001 | Cochran | 404/114 |
| 6,266,901 | B1 * | 7/2001 | Kanda et al. | 37/403 |
| 6,438,874 | B1 * | 8/2002 | LaBounty et al. | 37/403 |
| 6,553,694 | B1 * | 4/2003 | Martinez | 37/403 |
| 6,574,891 | B1 * | 6/2003 | Ireland et al. | 37/447 |
| 6,655,053 | B1 * | 12/2003 | Cummungs | 37/403 |
| 6,725,580 | B1 * | 4/2004 | Eriksson et al. | 37/241 |

FOREIGN PATENT DOCUMENTS

| | | |
|---|---|---|
| DE | 100 49 552 C | 10/2001 |
| DE | 202 15 843 | 2/2003 |
| JP | 11222807 | 7/1999 |

* cited by examiner

*Primary Examiner*—Victor Batson
(74) *Attorney, Agent, or Firm*—Michael J. Striker

(57) ABSTRACT

The current invention describes a tool mounting device that permits a rotating attachment of a tool to an excavator arm in such a way that the tool can be used for work in relatively small work spaces, independent of the alignment of the excavator arm and the excavator.

9 Claims, 1 Drawing Sheet

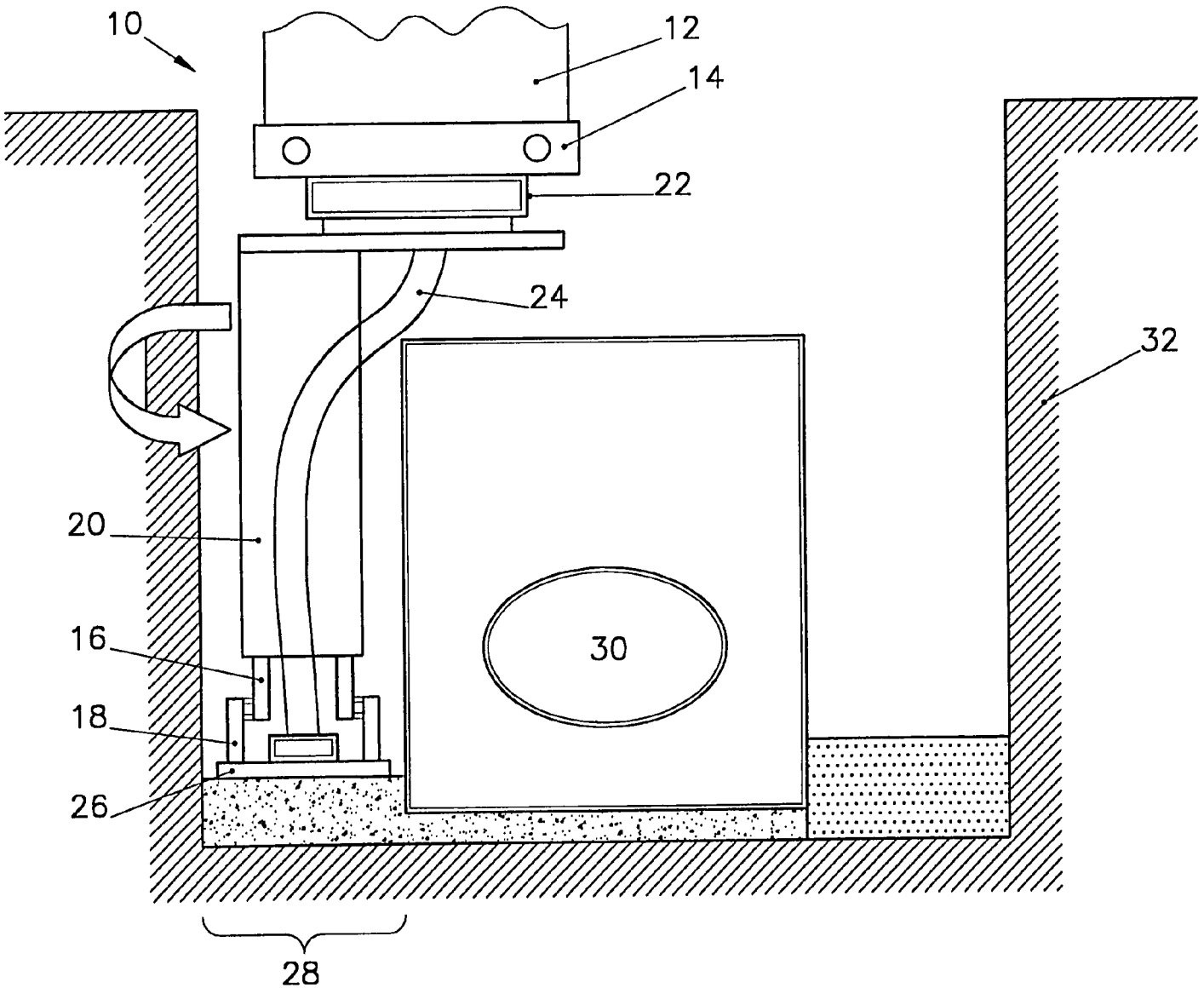
10
12
14
22
24
20
16
18
26
28
30
32

TOOL MOUNTING DEVICE

BACKGROUND OF THE INVENTION

The invention relates to a tool mounting device with which tools, for example a compacting device for compacting earth, can be mounted onto an excavator arm.

In addition to the shovel, excavator arms frequently have a wide variety of tools attached to them, for example chisels or compactors. A conventional excavator arm and the attaching device with which the tool is attached to the excavator arm have certain dimensions, which are relatively large, particularly in large excavators.

In tasks where space is limited, for example when working in narrow trenches or shafts as is frequently the case in pipeline construction, it is difficult to use these relatively large excavators because the excavator arm or the tool attaching device are too wide to be lowered into the trench or the shaft. This problem can in fact be solved by widening the trench or shaft so that the excavator arm can work in it, but this represents an excessive and costly amount of effort.

This is why the prior art, for example DE 100 49 552 C1, has disclosed mounting devices with which a tool can be fastened to the excavator arm at a certain distance. These mounting devices have smaller dimensions than the excavator arm or the conventional attaching devices so that these mounting devices and a correspondingly small tool can be used for work in narrow trenches or shafts.

The tool mounting devices that have been known up till now have the disadvantage that the excavator must always be aligned in a particular direction, for example parallel to or flush with the trench or shaft in order to allow the tool attached to the mounting device to be used for work in the narrow trench or shaft. This is very disadvantageous in roadwork in which the construction vehicles frequently have only a small amount of space in which to move.

SUMMARY OF THE INVENTION

The object of the invention is to design a tool mounting device for mounting tools onto an excavator arm so that the tool can be moved flexibly enough that the excavator does not absolutely have to be positioned in a particular alignment in relation to a trench or shaft in order to permit the tool that is mounted onto the tool mounting device to be used for work in the trench or shaft.

The stated object is attained according to the invention by means of the tool mounting device that has the features embodied in the main claim. The dependent claims disclose preferred modifications.

In the tool mounting device according to the invention, an excavator arm attaching device, with which the tool mounting device is attached to the excavator arm, is provided at one end and a tool attaching device for attaching the tool, for example a compacting device, is provided at the other end. Between these two attaching devices, there is a spacer device that connects the two attaching devices. This spacer device has a rotation device that allows the tool attaching device to be rotated in relation to the excavator arm attaching device.

Because the rotation device can rotate the tool in relation to the excavator arm attaching device, the excavator can be positioned in any alignment in relation to the trench or hole and the tool can still move in a direction in the trench or hole independent of the alignment of the excavator. Consequently, the excavator can be positioned as a function of the spatial conditions of the construction site without having to take into account its precise alignment with the trench or shaft.

In another advantageous embodiment, the tool attaching device is fastened eccentrically to the rotation device. This offers the advantage that the tool can even be guided behind obstacles such as a laid pipe and can carry out work there. This advantage of being able to reach behind an obstacle is further increased if the spacer device and the tool fastened to it protrude beyond the dimensions of the rotation device.

To allow the tool to be actuated, the spacer device that connects the excavator arm attaching device to the tool attaching device is advantageously provided with hydraulic lines, one end of which are attached to the hydraulic lines of the excavator and the other end of which are attached to the tool, so that the hydraulic forces, i.e. the hydraulic pressure, that are used for moving the excavator arm can also be used for driving the tool.

In an advantageous embodiment, the hydraulic lines are routed through the spacer device so that they do not hinder the rotary movement.

The rotation device itself can advantageously also be moved hydraulically or also electrically or mechanically. It is also advantageous if the rotation device can rotate endlessly, i.e. has no stop.

It is advantageous if the excavator arm attaching device of the tool mounting device is comprised of a quick-change plate of the kind usually used for attaching tools to an excavator arm.

Various tools can be attached to the tool mounting device according to the invention, for example a compacting device that has a hydraulically actuated compacting plate that moves up and down.

An exemplary embodiment of a tool mounting device according to the invention will be explained below in conjunction with the accompanying drawing.

BRIEF DESCRIPTION OF THE DRAWINGS

The sole figure schematically depicts a side view of a tool mounting device according to the invention; the tool indicated here by way of example is a compacting device.

At its upper end, the tool mounting device 10 has an excavator arm attaching device 14, which is embodied here in the form of a quick-change plate. This attaching device 14 attaches the tool mounting device to the excavator arm 12 depicted here in schematic form.

DETAILED DESCRIPTION OF THE PREFERRED EMBODIMENTS

At its lower end, the tool mounting device 10 has a tool attaching device 16. The tool 18 to be actuated, which in this case is a compacting device with a compacting plate 26, is attached to this tool attaching device 16. The tool attaching device 16 is connected to the excavator arm attaching device 14 by means of a spacer device 20 that is embodied here in the form of an elongated cylinder. At its upper end, the spacer device 20 has a rotation device 22, which allows the spacer device 20 and the tool 18 that is attached to it via the tool attaching device 16 to rotate in relation to the excavator arm attaching device 14 and therefore the excavator arm 12. In this case, in an advantageous embodiment form, the spacer device 20 is attached to the rotation device 22 eccentrically so that the tool 18 can be introduced even into very hard-to-reach work spaces situated behind obstacles.

The fact that the eccentric attachment protrudes beyond the dimensions of the excavator arm 12 or the excavator arm attaching device 14 makes it easier to access such hard-to-reach work spaces. This protrusion of the eccentric attachment beyond the dimensions of the excavator arm can also be even more pronounced so that the entire compacting plate 26 lies outside the excavator arm attaching device 14.

The drawing also shows a hydraulic line 24 that connects the hydraulic lines of the excavator arm 12, not shown here, to the tool 18 so that the tool can be hydraulically actuated.

As is clear from the drawing, the tool mounting device 10 according to the invention permits work to be carried out in a narrow trench section 28, for example next to a pipe 30 laid in a trench 32, whose dimensions are so small that the excavator arm 12 cannot work in it directly.

REFERENCE NUMERAL LIST

10 tool mounting device
12 excavator arm
14 excavator arm attaching device
16 tool attaching device
18 tool (compacter)
20 spacer device
22 rotation device
24 hydraulic line
26 compacting plate
28 narrow trench section
30 pipe
32 trench

The invention claimed is:

1. A tool mounting device for mounting tools (18) onto an excavator arm (12), which has an excavator arm attaching device (14) for attaching the tool mounting device (10) to the excavator arm (12) at one end, a tool attaching device (16) for attaching tools (18) to the tool mounting device (10) at another end and spaced from the excavator arm attaching device (14) in a first direction, and between these two attaching devices as considered in the first direction, a spacer device (20) that connects excavator arm attaching device (14) to the tool attaching device (16) in a movable fashion, characterized in that the spacer device (20) includes a rotation device (22) that makes it possible to rotate the tool attaching device (16) in relation to the excavator arm attaching device (14), wherein the spacer device (20) is fastened eccentrically to the rotation device (22) in a second direction which is transverse to the first direction.

2. The tool mounting device according to claim 1, wherein the spacer device (20) is fastened eccentrically to the rotation device (22) so that it protrudes beyond the dimensions of the excavator arm attaching device (14).

3. The tool mounting device according to claim 1, wherein the spacer device (20) has one or more hydraulic lines (24), which are connected to hydraulic lines of the excavator arm (12) at one end and are connected to the tool (18) to be actuated at another end.

4. The tool mounting device according to claim 3, wherein the hydraulic lines (24) are routed through the rotation device (22).

5. The tool mounting device according to claim 1, wherein the rotation device (22) is driven mechanically, hydraulically, or electrically.

6. The tool mounting device according to claim 1, wherein the rotation device (22) has no stop, but can instead be rotated endlessly.

7. The tool mounting device according to claim 1, wherein the excavator arm attaching device (14) is embodied in the form of a quick-change plate.

8. The tool mounting device according to claim 1, wherein the tool (18) is an earth-compacting device.

9. The tool mounting device according to claim 8, wherein the earth-compacting device (18) has a compacting plate (26) that moves up and down.

* * * * *